United States Patent [19]

Riegert et al.

[11] Patent Number: 4,741,064

[45] Date of Patent: May 3, 1988

[54] COMBINATION PAINT BRUSH/PAINT CAN OPENER/SCRAPER

[76] Inventors: William J. Riegert, 54 Lake Shore Dr., Lake Ronkonkoma, N.Y. 11779; George Spector, 233 Broadway, Rm. 3815, New York, N.Y. 10007

[21] Appl. No.: 891,137

[22] Filed: Jul. 31, 1986

[51] Int. Cl.[4] ..... A47L 13/02; A47L 13/12

[52] U.S. Cl. ..... 15/111; 15/236 R; 7/105; 7/151

[58] Field of Search ..... 15/105, 111, 236 R; 7/105, 151

[56] References Cited

U.S. PATENT DOCUMENTS

| | | | |
|---|---|---|---|
| 412,002 | 10/1889 | Schroen | 15/236 R |
| 2,603,991 | 7/1952 | Oliver | 15/106 X |
| 3,947,913 | 4/1976 | Nelson | 15/111 |

FOREIGN PATENT DOCUMENTS

| | | | |
|---|---|---|---|
| 689059 | 3/1953 | United Kingdom | 15/111 |

*Primary Examiner*—Peter Feldman

[57] ABSTRACT

A combination paint brush, paint can opener and scraper tool is provided and consists of a blade extending from an extreme end of a paint brush handle for easy opening of a paint can lid and removing loose paint from hard to get places.

2 Claims, 1 Drawing Sheet

COMBINATION PAINT BRUSH/PAINT CAN OPENER/SCRAPER

BACKGROUND OF THE INVENTION

The instant invention relates generally to painting tools and more specifically it relates to a combination paint brush, paint can opener and scraper tool.

Numerous painting tools have been provided in prior art that are adapted to consist of a paint brush having a handle with a scraper blade attached thereto. For example U.S. Pat. Nos. 926,894; 1,421,478 and 2,914,785 all are illustrative of such prior art. While these units may be suitable for the particular purpose to which they address, they would not be as suitable for the purposes of the present invention as heretofore described.

SUMMARY OF THE INVENTION

A primary object of the present invention is to provide a combination paint brush, paint can opener and scraper tool that will overcome the shortcomings of the prior art devices.

Another object is to provide a combination paint brush, paint can opener and scraper tool that serves as a three in one tool, such as applying paint to a surface, easy opening of paint can lids and removing loose paint from hard to get places.

An additional object is to provide a combination paint brush, paint can opener and scraper tool that includes a pivotable leverage arm to assist in removing the paint can lid.

A further object is to provide a combination paint brush, paint can opener and scraper tool that is simple and easy to use.

A still further object is to provide a combination paint brush, paint can opener and scraper tool that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
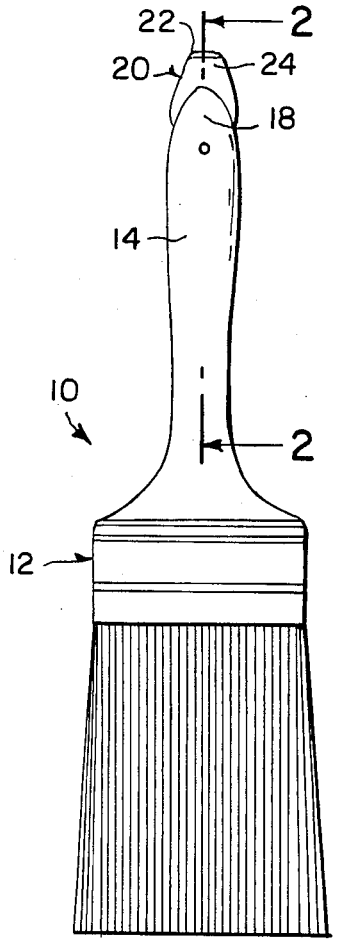
FIG. 1 is a front view of a paint brush embodying the invention.
Figure 2:
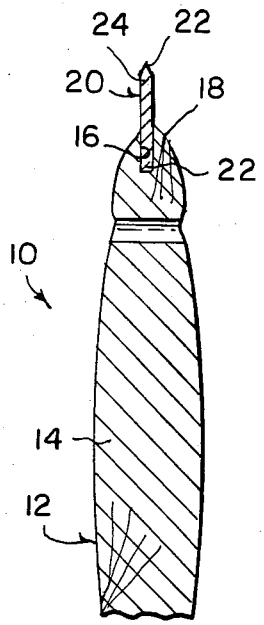
FIG. 2 is an enlarged cross sectional view taken along line 2—2 in FIG. 1 showing the paint scraper and lid opening blade.

Turning now descriptively to the drawings, in which similar reference characters denote similar elements throughout the several views, FIGS. 1 and 2 illustrates a combination paint brush, paint can opener and scraper tool 10 that consists of a paint brush 12 that has a handle 14 with a slot 16 in extreme end 18 thereof. A blade 20 has one end 22 tightly secured within the slot 16. The blade 20 can extend outwardly therefrom for easy opening of a paint can lid (not shown) and removing loose paint from hard to get places. The blade 20 includes a beveled edge 22 at free end 24 thereof and is fabricated out of thin metal material.

Figure 4:
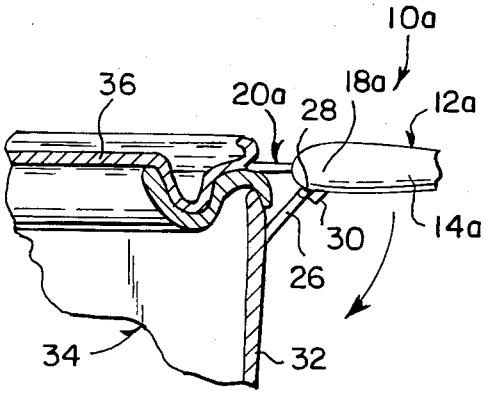
FIG. 4 is a side view partly in cross section showing another modification whereby the paint brush handle includes a pivotable leverage arm to assist in removing the paint can lid, wherein the arm is normally in a position abutting the opening blade.

FIG. 4 shows a modified tool 10*a* containing a leverage arm 26 pivotly mounted at 28 to the extreme end 18*a* of the handle 14*a* adjacent the blade 20*d*. The arm 26 is normally spring biased in a closed position abutting the blade 20*a*. A stop member 30 is mounted to the extreme end 18*a* of the handle 14*a* adjacent the leverage arm 26 to keep the arm in a secured open angular position when the arm is against side 32 of a paint can 34 and the blade 20*a* is used for opening the paint can lid 36.

Figure 3:
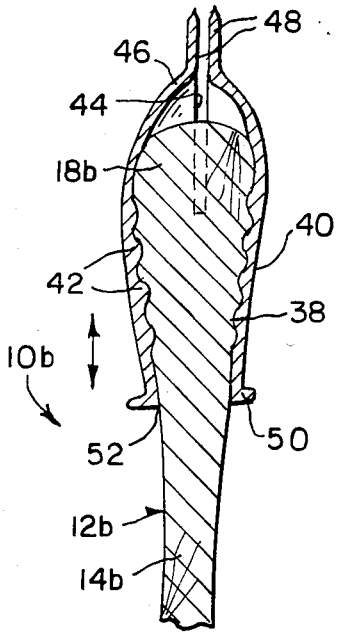
FIG. 3 is an enlarged cross sectional view similar to FIG. 2 showing a modification whereby a retractable sheath adjusts the fingers on end for different thickness of paint can lids.

FIG. 3 shows another modified tool 10*b* containing a paint brush 12*b* that has a handle 14*b* which is thicker at extreme end 18*b* thereof with a plurality of notches 38 thereon. A retractable metal sheath 40 is provided which fits over the handle 14*b*. The sheath has a plurality of internal ridges 42 to contact the notches 38. An elongated slit 44 is at closed end 46 thereof. A pair of blades 48 are spaced apart between the slit 44 and extends therefrom. A flange 50 is around open end 52 thereof. The sheath 40 above the flange 50 can be gripped, moved up and down the handle 14*b* for adjusting the blades 48 between the slit 44. The blades 48 are for engaging and removing different thicknesses of paint can lids and removing loose paint from hard to get places.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A combination paint brush, paint can opener and scraper tool comprising:

(a) a paint brush having a handle being thicker at extreme end thereof with a plurality of notches thereon; and (b) a retractable metal sheath which fits over said handle, said sheath having a plurality of internal ridges to contact said notches, an elongated slit at closed end thereof, a pair of blades spaced apart between said slit and extending therefrom and a flange around open end thereof so that said sheath above said flange can be gripped, moved up and down said handle for adjusting said blades between said slit for engaging and removing different thicknesses of paint can lids and removing loose paint from hard to get places.

2. A combination paint brush, can opener and scraper tool comprising a paint brush with a handle having a blade unit for scraping and opening can lids mounted on said handle in combination with means for improving the efficiency of said blade in removing can lids, wherein said means comprises said blade unit being formed of a pair of spaced blades extending from a sheath adjustably mounted on said handle whereby adjusting said sheath on said handle causes the space between the blades to vary.

* * * * *